United States Patent [19]

Nakamura et al.

[11] Patent Number: 4,916,357

[45] Date of Patent: Apr. 10, 1990

[54] SHADOW MASK ASSEMBLY OF A COLOR CATHODE RAY TUBE

[75] Inventors: Michio Nakamura, Saitama; Toshinao Sone, Kumagaya; Tohru Takahashi; Masami Hasegawa, both of Fukaya, all of Japan

[73] Assignee: Kabushiki Kaisha Toshiba, Kawasaki, Japan

[21] Appl. No.: 182,155

[22] Filed: Apr. 15, 1988

[30] Foreign Application Priority Data

Apr. 16, 1987 [JP] Japan ..... 62-91919
Dec. 17, 1987 [JP] Japan ..... 62-317539

[51] Int. Cl.[4] ..... H01J 29/07

[52] U.S. Cl. ..... 313/402; 313/406; 313/407; 313/404

[58] Field of Search ..... 313/402, 404, 406, 407, 313/269

[56] References Cited

U.S. PATENT DOCUMENTS

| | | | |
|---|---|---|---|
| 3,454,813 | 7/1969 | Lewinson | 313/406 X |
| 3,743,878 | 7/1973 | Kautz et al. | 313/404 X |
| 4,335,329 | 6/1982 | Fukuzawa et al. | 313/407 X |
| 4,358,702 | 11/1982 | Gijrath et al. | 313/404 |
| 4,506,188 | 3/1985 | Puhak | 313/405 |

FOREIGN PATENT DOCUMENTS

| | | | |
|---|---|---|---|
| 0207724 | 1/1987 | European Pat. Off. . | |
| 0245445 | 10/1986 | Japan | 313/404 |
| 61-196446 | 12/1986 | Japan . | |

*Primary Examiner*—Donald J. Yusko
*Assistant Examiner*—Michael Horabik
*Attorney, Agent, or Firm*—Cushman, Darby & Cushman

[57] ABSTRACT

A color cathode ray tube according to this invention comprises a cylindrical neck section having an electron gun which emits three electron beams, a funnel section extending from the neck section, and a panel section having a faceplate on which an image is formed. Phosphor stripes for emitting red, green, and blue light rays, upon electron beams landing thereon, are formed on an inner surface of a faceplate of the panel. A shadow mask having slit apertures for directing the three electron beams onto the corresponding phosphor stripes is arranged in the panel, and is welded to a mask frame which is suspended and supported on the panel by supporting structures welded to the frame. Each supporting structure comprises a fixed section secured to the frame, and a movable section having a hole into which a panel pin is fitted. The supporting structures are strongly resistant to impact forces, as a result of having twist-prevention sections which are fixed close to a movable section thereof which is liable to plastic deformation.

8 Claims, 5 Drawing Sheets

SHADOW MASK ASSEMBLY OF A COLOR CATHODE RAY TUBE

BACKGROUND OF THE INVENTION

1. Field of the Invention

This invention relates to a shadow mask of a color cathode ray tube and, more particularly, to improvement of a supporting structure for holding the shadow mask therethrough on the panel.

2. Description of the Related Art

A shadow mask type color cathode ray tube is composed of a panel having a substantially rectangular faceplate, a substantially cylindrical neck in which an electron gun is arranged and a funnel extending from the neck. Formed on the inner surface of the faceplate is a phosphor screen which emits red, blue, and green light rays when electron beams land thereon. A rectangular shadow mask made of a thin metal plate and having a large number of slit apertures is arranged in the panel such that it opposes the phosphor screen. This shadow mask is fixed in place by welding a peripheral portion thereof to a rectangular frame. Supporting structures, which are resiliently deformable, are fixed in place by welding to the corners of the frame. The frame is held in the panel as the resiliently deformable supporting structures are attached to panel pins fixed on an inner surface of the skirt. The elastically deformable supporting structures serve to hold the shadow mask, thereby preventing discoloration, which is caused by a relative displacement between the apertures of the shadow mask and the phosphor stripes of the screen, when the shadow mask and the frame are heated and expand. Therefore, when the cathode ray tube begins operating, the shadow mask is moved slightly, by the supporting structures, toward the phosphor screen, thereby making it possible to obtain a high color purity.

The supporting structures which hold the frame having the shadow mask welded thereto on the panel are indicated in U.S. patent application No. 844,553 now U.S. Pat. No. 4,723,088; U.S. patent application No. 878,680 now U.S. Pat. No. 4,728,853 and U.S. patent application No. 120,982 and in U.S. Pat. No. 4,652,792 and in attorney dockets No. 62P850, identified by Ser. No. 07/149,049, and 63P069, filed Mar. 2, 1988 as Ser. No. 163,100 now U.S. Pat. No. 4,886,997,and a supporting structure as shown in FIGS. 1 and 2 is disclosed in U.S. Pat. No. 4,723,088. As shown in FIG. 1, supporting structure 1, which is made by bending a stainless plate in a U-like configuration, has fixed section 4 fixed by welding to frame 3, connecting section 2 in a U-like configuration and engaging section 5 with hole 6 into which a panel pin is inserted. Supporting structure 10 shown in FIG. 2 comprises fixed plate 13 fixed by welding to frame 12 and movable plate 14. Movable plate 14 has connecting section 16 and engaging section 17 formed by bending a plate section extending from welded section 15 welded to fixed plate 13. A hole 18 is formed in engaging section 17. The frame having supporting structure 1 or 10 fixed thereto is mounted to and dismounted from the panel several times during the manufacturing process of color cathode ray tubes. Hence, the supporting structures must be in such a shape that they do not suffer plastic deformation when they are mounted and dismounted repeatedly. Supporting structures 1 and 10 shown in FIGS. 1 and 2, respectively, are formed in shapes less susceptible to plastic deformation. However, these supporting structures have a drawback that they are easily deformed by an external impact applied to the color cathode ray tube. More specifically, as shown in FIG. 1, when a force in the direction of the arrow F1 is applied from a periphery of hole 6 to engaging section 5 by an external impact and a force in the direction of the arrow F2 is applied from frame 3 to fixing section 4, supporting structure 1 is deformed such that the radius of the circular part of first side end portion 7 of connecting section 2 becomes larger and the radius of the circular part of second side end portion 8 becomes smaller. As a result, connecting section 2 is deformed permanently. Referring to FIG. 2, supporting structure 10, having a construction such that two metal plates are welded together, is higher in strength to withstand a force resulting from an impact applied to connecting section 16 and is thus prevented from being twisted and deformed permanently to the maximum extent feasible. However, if a force in the direction of the arrow F4 is applied to fixed plate 13 and a force in the direction of the arrow F3 is applied to movable plate 14, there is still a possibility that connecting section 16 is twisted and deformed permanently just as with supporting structure 1. With these supporting structures, if one wishes to decrease the amount of plastic deformation, it is necessary to increase the thickness of the metal plate. If the thickness of the metal plate is increased, it becomes necessary to apply a greater force to the supporting structures in mounting and dismounting the frame in the manufacturing process of color cathode ray tubes. Therefore, a longer time is taken in mounting and dismounting the frame and thus, the efficiency in mounting and dismounting the frame is decreased. Further, if the thickness of the metal plate of the supporting structures is increased, a large force is applied to the shadow mask when the frame is mounted and dismounted and the relatively thin shadow mask is deformed. Such being the situation, it has been desired that a supporting structure should be materialized that assures high work efficiency in the manufacturing process and suffers a reduced amount of deformation due to a twist which occurs when an impact is applied.

SUMMARY OF THE INVENTION

The object of this invention is to provide a color cathode ray tube incorporating supporting structures which are used to mount a frame having a shadow mask welded thereto to the panel and which do not suffer plastic deformation in the manufacturing process and are subject to a reduced torsional deformation caused by a force generated by an impact.

According to this invention, it is possible to provide a color cathode ray tube comprising a vacuum envelope with an axis and including a panel, a funnel and a neck, the panel being composed of a faceplate, a front view shape of which is substantially rectangular and which has an inner surface, and a skirt with a peripheral inner surface extending from a peripheral edge of the faceplate, said funnel being contiguous to the skirt of the panel, and the neck being substantially cylindrical and contiguous of the funnel;

a phosphor screen formed on the inner surface of the faceplate;

an electron gun assembly, arranged in the neck, for emitting three electron beams which impinge on the phosphor screen;

a shadow mask arranged in the panel to opposite the phosphor screen and having a plurality of apertures for allowing passage therethrough of the three electron beams from the electron gun assembly;

frame means, substantially rectangular, for fixing said shadow mask;

a plurality of panel pins fixed on an inner surface of the skirt and protruding toward the inside; and elastically deformable supporting means for supporting the frame means on the peripheral inner surface of the skirt, each of the supporting means comprising a fixed section fixed to the frame means, a movable section having a hole into which the panel pin is fitted and twist-prevention sections for preventing the support means from being twisted by a force given by an impact.

According to this invention, since the supporting means are provided with twist-prevention sections, they can be easily mounted to and dismounted from the panel during the manufacturing process and their deformation caused by an impact can be reduced. Thus, the work efficiency in the manufacturing process of color cathode ray tubes is improved and since the shadow mask is held at the correct position in the panel, the electron beams can be landed accurately on the phosphor screen.

DETAILED DESCRIPTION OF THE PREFERRED EMBODIMENTS

Figure 3:
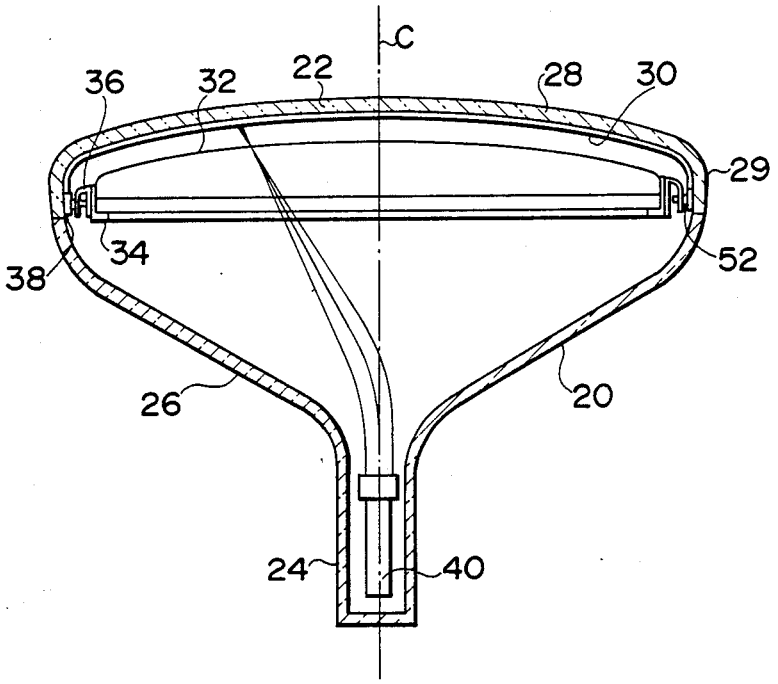
FIG. 3 is a sectional view of an embodiment of the color cathode ray tube according to this invention.

FIG. 3 shows an embodiment of the color cathode ray tube according to this invention. Color cathode ray tube 20 comprises glass panel 22 and glass funnel 26 having cylindrical glass neck 24. Panel 22 and funnel 26 are fused together and color cathode ray tube 20 is airtightly closed and kept under vacuum. Electron gun assembly 40 of the inline type which emits three electron beams is accommodated in neck 24. Panel 22 comprises substantially rectangular faceplate 28 and skirt 29 forming the peripheral edge of panel 22. Formed on the inner surface of faceplate 28 is phosphor screen 30 made of three types of phosphor layers applied in stripes such that they emit red, green and blue light rays when the electron beams land thereon. Rectangular metal shadow mask 32 having a large number of apertures in thin slits is arranged and fixed in panel 22 such that the three electron beams projected from electron gun assembly 40 are incident on phosphor layers 30 of three types, respectively. Shadow mask 32 is made of iron or invar material about 0.2 mm thick. Shadow mask 32 is fixed by welding its periphery to rectangular frame 34. Supporting structures 36 for holding shadow mask 32 are fixed by welding to the four corners of frame 34. Panel pins 38 provided at four inside corners of skirt 29 are fitted into holes 52 cut in supporting structures 36. In this way, shadow mask 32 is held in panel 22 to oppose phosphor screen 30 with a specified gap provided between them.

In shadow mask type color cathode ray tube 20, the three electron beams projected from electron gun assembly 40 are focused on phosphor screen 30 and they are converged on shadow mask 32. The three electron beams that have passed through the apertures of shadow mask 32 are landed on the phosphor stripes of phosphor screen 30 that emit light rays of colors corresponding to each of the electron beams. Those of the three electron beams which were emitted from electron gun assembly 40 but do not pass through the apertures and bombard on shadow mask 32 and are converted into heat on the surface thereof. Therefore, when the color cathode ray tube is in operation, shadow mask 32 is heated and expands. In order that the relative position of aperture of shadow mask 32 with respect to phosphor stripe of phosphor screen 30 may not be changed even when shadow mask 32 expands, shadow mask 32 is provided with supporting structures 36 that allow shadow mask 32 to move toward phosphor screen 30, when the temperature rises.

Figure 4:
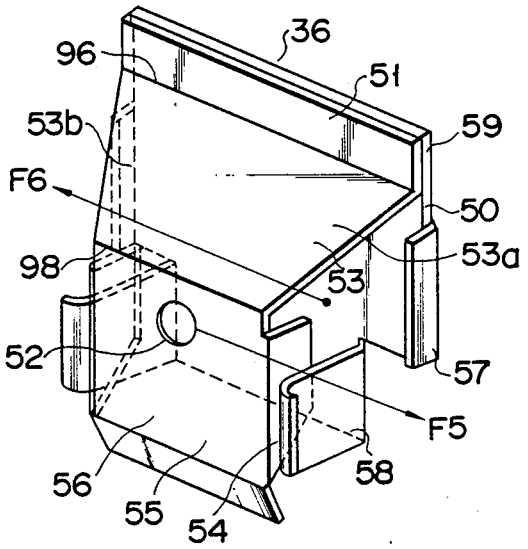
FIG. 4 is a schematic perspective view of the supporting structure mounted in the color cathode ray tube of FIG. 3.
Figure 5:
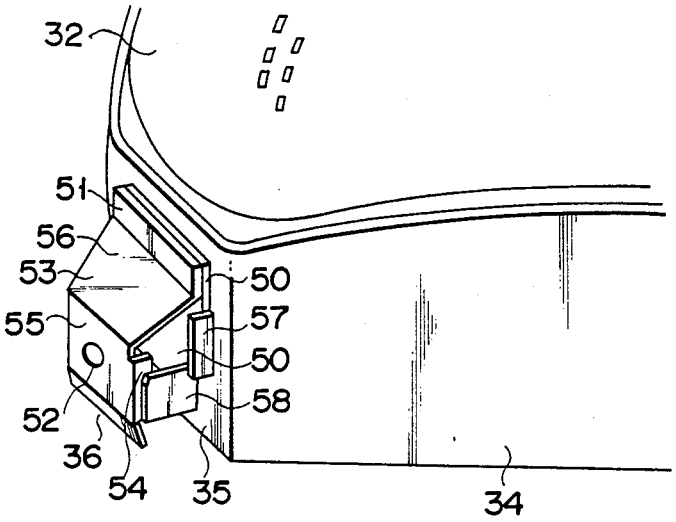
FIG. 5 is a schematic perspective view of a frame to which the supporting structure of FIG. 4 is fixed.
Figure 6A:
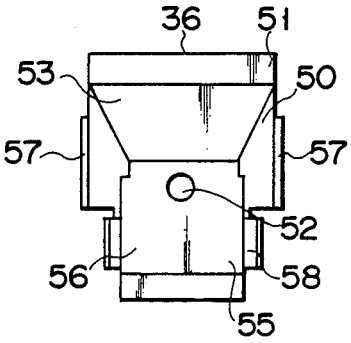
FIGS. 6A, 6B, and 6C are a front view, a side view and a bottom end view of the supporting structure of FIG. 4, respectively.
Figure 6B:
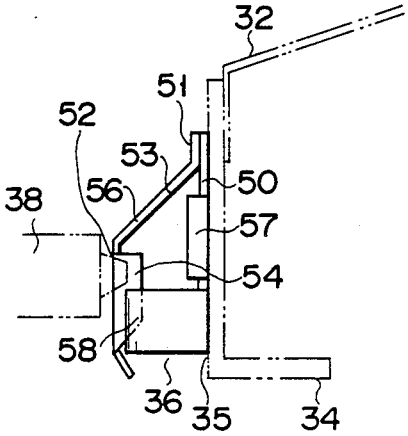
Figure 6C:
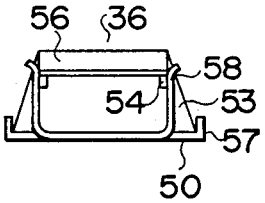
Figure 7:
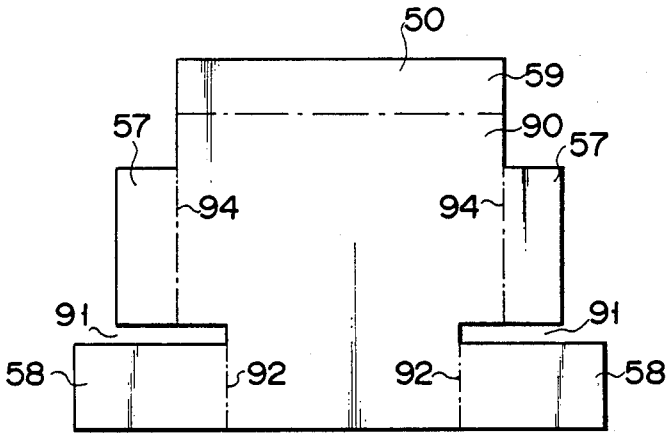
FIG. 7 is a development of a fixed plate of the supporting structure of FIG. 4.
Figure 8:
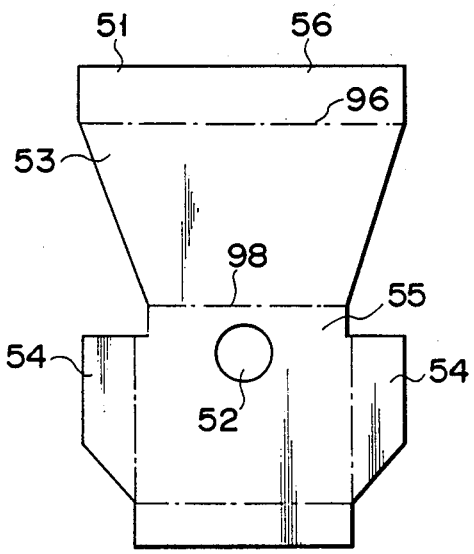
FIG. 8 is a development of a movable plate of the supporting structure of FIG. 4.

Supporting structure 36 according to one embodiment of this invention is shown in FIGS. 4, 5, 6A, 6B, and 6C. Supporting structure 36 comprises fixed plate 50 secured to frame 34 and movable plate 56 having hole 52 into which panel pin 38 is inserted. Fixed plate 50 is welded to corner 35 of frame 34 and is also welded to movable plate 56 made of stainless steel. FIG. 7 is a development of fixed plate 50. Fixed plate 50 has base section 90 which is substantially rectangular and has the reverse side to be welded to corner 35. Rectangular welded part 59, the surface of which is welded to movable plate 56, is provided adjacent to the upper end of base section 90. Two twist-prevention plates 58 which are bent at a right angle, as it were, upward from the drawing with respect to base section 90 and along bending lines 92 are provided on both sides and adjacent to the lower end portion of base section 90. Notches 91 are provided along the upper ends of both twist-prevention plates 58. Stiffening sections 57 which are bent at a right angle, as it were, upward from the drawing with respect to base section 90 and along bending lines 94 are provided above notches 91 on both sides so as to reinforce plates 50. FIG. 8 is a development of movable plate 56. Movable plate 56 has welded section 51, the reverse side of which is welded to welded section 59 of fixed plate 50. Movable plate 56 comprises connecting section 53 which is bent, as it were, upward from the drawing with respect to welded section 51 and along bending line 96 and engaging section 55 being adjacent, through bending line 98, to connecting section 53, bent so as to be parallel with welded section 51 and having hole 52 into which panel pin 38 is fitted. Two side plates 54 are provided on both sides of engaging section 55 and are bent at a right angle, as it were, downward from the drawing with respect to connecting section 55 to respectively oppose twist-prevention sections 58 the same specified distances separated therefrom. FIG. 4 shows supporting structure 36 having fixed plate 50 and movable plate 56 welded together. When supporting structure 36 is not subjected to a force causing a torsion, the gap between twist-prevention plate 58 and side plate 54 is kept at 0.1 to 0.5 mm. Fixed plate 50 and movable plate 56 are made of a stainless steel (SUS 631) about 0.4 mm thick.

Figure 1:
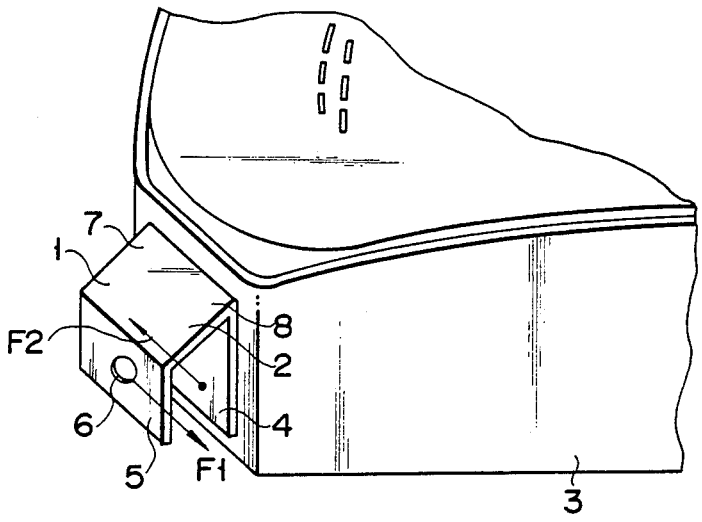
FIG. 1 (PRIOR ART)
FIG. 1 is a schematic perspective view of one example of the supporting structure mounted in a conventional color cathode ray tube.
Figure 2:
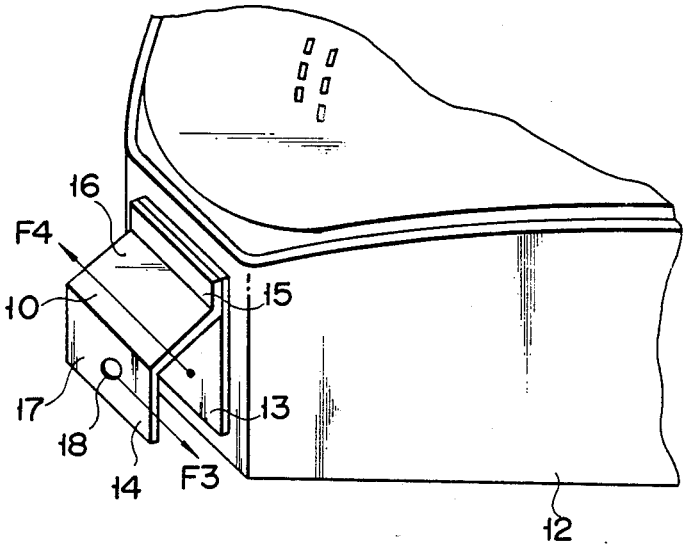
FIG. 2 (PRIOR ART)
FIG. 2 is a schematic perspective view of another example of the supporting structure mounted in a conventional color cathode ray tube.

Let us suppose that an external impact is applied to color cathode ray tube 20 and fixed plate 50 is subjected to a resulting force acting in the direction of the arrow F6 and movable plate 56 is to a resulting force acting in the direction of the arrow F5. The force in the arrow direction of F6 is applied from frame 34 to fixed plate 50 and the force in the arrow direction of F5 is applied from panel pin 38 fitted in hole 52 to movable plate 56. Owing to the forces in the arrow directions of F6 and F5, first side end portion 53*a* and second side end portion 53*b* of connecting section 53 are subjected to a force acting toward the top position and a force acting toward the bottom position of FIG. 4, respectively. As a result, connecting section 53 is twisted. However, since side plate 54 of movable plate 56 contacts twist-prevention section 58, the twist of movable section 56 is hindered. Therefore, when a force is applied to supporting structure 36, the amount of plastic deformation of movable section 56 due to twisting is reduced greatly. Let a 21-inch 90° color cathode ray tube using conventional supporting structures 1 shown in FIG. 1 be A, a 21-inch 90° color cathode ray tube using conventional supporting structures 10 shown in FIG. 2, B and a 21-inch 90° color cathode ray tube using supporting structure 36 according to this invention, shown in FIG. 4, C. By giving an impact in parallel with face plate 28 to these supporting structures, variations in beam landing due to deformation of the supporting structure were measured.

The results are as follows.

Variation in A . . . 102 μm

Variation in B . . . 56 μm

Variation in C . . . 25 μm

A 0.4 mm stainless steel SUS 631 3/4H was used for the supporting structures. As shown above, when a supporting structure according to this invention is used, the variation in beam landing is reduced remarkably though the supporting structure is subjected to a force produced by an impact. The position of shadow mask 32 with respect to phosphor layer 30 is hardly displaced, changes hardly occur in beam landing even when an impact is given to the color cathode ray tube.

As mentioned above, supporting structure 36 was made of a 0.4 mm stainless steel. It is also possible to make fixed plate 50 a little thicker, for example, by using a 0.5 mm stainless steel for fixed plate 50 and a 0.4 mm stainless steel for movable plate 56. By using a thicker stainless steel for fixed plate 50, the strength against impacts can be improved. Frame 34 is mounted and dismounted by moving movable plate 56 and welded section 59 which is a part of fixed plate 50. When fixed plate 50 with increased thickness is used, there is scarcely any adverse effect on the mounting and dismounting of the frame during the manufacturing process of color cathode ray tubes. Therefore, so long as the proportion of the increased thickness of stainless steel for fixed section 50 is at most about 1 to 2 times that of stainless steel for movable section 56, it is fairly possible to make a modification with regard to the thickness.

Figure 9:
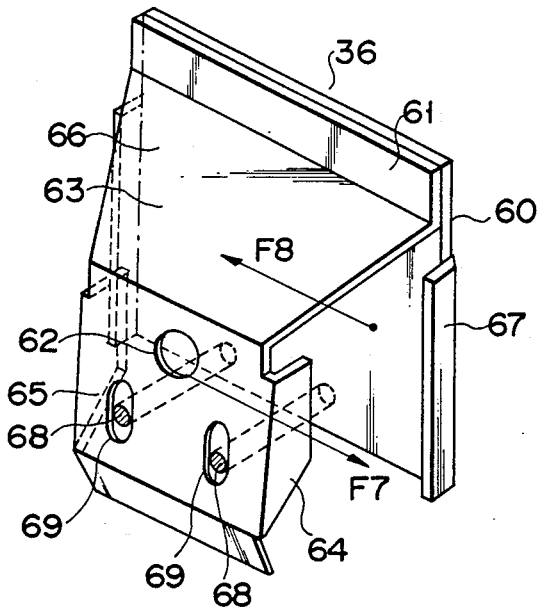
FIG. 9 is a schematic perspective view of a modification of this invention.

FIG. 9 shows a modification of this invention. Supporting structure 36 according to this modification is made of two stainless steel plates. Supporting structure 36 has fixed plate 60 which is welded to corner 35 of frame 34. Movable plate 66 is welded to a top end portion of fixed plate 60. Two cylindrical twist-prevention members 68 protruding perpendicularly from fixed plate 60 are fitted in lower positions of fixed plate 60 close to a bottom end thereof. Movable plate 66 includes welded section 61 welded to fixed plate 60 on that surface of fixed plate 60 which is not welded to frame 34, connecting section 63 bent from welded section 61 so as to be separated from fixed plate 60 and engaging section 65 bent so as to be parallel with welded section 61 and having hole 62 into which panel pin 38 is fitted. In engaging section 65, there are provided two long and narrow twist-prevention holes 69 into which cylindrical twist-prevention members 68 are inserted. Provided adjacent to both sides of engaging section 65 are two side plates 64 which are bent at a right angle with respect to engaging plate 65. Fixed plate 60 has two stiffening sections 67 which are bent at a right angle from fixed plate 60. When an external impact causes a force in the arrow direction of F7 to be applied to movable plate 66 and a force in the arrow direction of F8 to be applied to fixed plate 60, connecting section 63 is twisted in supporting structure 36 of the above construction. However, cylindrical twist-prevention members 68 fitted in twist preventive holes 69 hinder movable plate 66 from moving. Thus, the amount of plastic deformation of supporting structure 36 due to twisting is reduced remarkably. Therefore, the same effects as in the first embodiment can be obtained.

Figure 10:
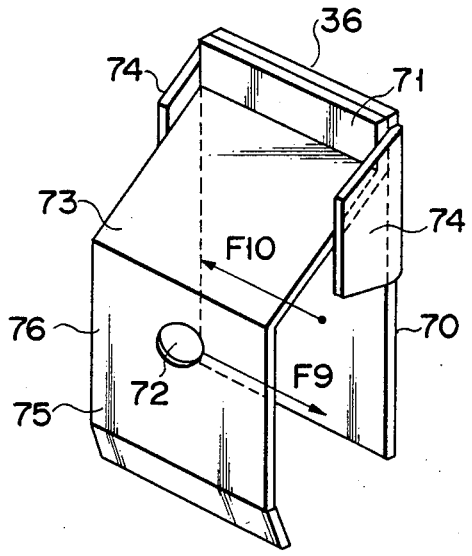
FIG. 10 is a schematic perspective view of the supporting structure according to another modification of this invention.

FIG. 10 shows another modification of this invention. Supporting structure 36 of this modification is made of two stainless steel plates. Supporting structure 36 has fixed plate 70 welded to corner 35 of frame 34. Movable plate 76 is welded to a top end portion of fixed plate 70 and two twist-prevention sections 74 are provided on both sides and adjacent to the top end portion of fixed plate 70, the twist-prevention sections 74 being bent at a right angle with respect to fixed plate 70. Movable plate 76 includes welded section 71 welded to fixed plate 70, connecting section 73 bent with respect to welded section 71 so as to be separated from fixed plate 70 and engaging section 75 having hole 72 into which a panel pin 38 is fitted. An external force causes a force in the arrow direction of F9 to be applied to movable plate 76 and a force in the arrow direction of F10 to be applied to fixed plate 70. Connecting section 73 is twisted by these forces. However, twist-prevention sections 74 in contact with the side edges of movable plate 76 hinder movable plate 76 from moving. Thus, the amount of plastic deformation of supporting structure due to twisting is reduced remarkably. Therefore, the same effects as in the first embodiment can be obtained by the supporting structure of this modification.

In the above embodiments, the supporting structures are mounted at the corners of the frame, but they may be mounted near the middle portions between the corners of the frame. According to this invention, supporting structures are so rigidly constructed as to resist impacts. Therefore, the position of the shadow mask with respect to the phosphor screen is hardly changed, so that electron beams from the electron gun assembly can land accurately on the phosphor stripes. Though rigidly structured to be able to resist impacts, the supporting structures according to this invention allow easy mounting and dismounting of shadow masks during the manufacturing process of color cathode ray tubes. Therefore, shadow masks are prevented from being deformed by forces applied to the supporting structures in mounting and dismounting shadow masks. Furthermore, the movable sections are guided by the twist-prevention sections and they are never twisted during the manufacturing process of color cathode ray tubes. As a result, color cathode ray tubes can be improved in performance.

What is claimed is:

1. A color cathode ray tube comprising:

a vacuum envelope having an axis and including a panel section, a funnel section, and a neck section, said panel section having a faceplate, a front view shape of which is substantially rectangular in shape and has an inner surface, and a skirt having a peripheral inner surface extending from a peripheral edge of said faceplate, said funnel section being contiguous to said skirt of said panel section, and said neck section being contiguous of said funnel section;

a phosphor screen formed on said inner surface of said faceplate;

an electron gun assembly, arranged in said neck section, for emitting three electron beams which land on said phosphor screen;

a shadow mask arranged in said panel section opposing said phosphor screen and having a large number of apertures for allowing passage therethrough of said three electron beams;

frame means, substantially rectangular in shape, for fixing said shadow mask in place;

a plurality of panel pins fixed on an inner surface of said skirt and protruding toward the inside; and unitary supporting structures for supporting said frame means on said peripheral inner surface of said skirt, each of said unitary supporting structures including a fixed section fixed to said frame means, a resiliently deformable section having one end portion fixed on said fixed section and a hole into which one of said plurality of panel pins is fit, and twist-prevention sections for preventing twisting of said resiliently deformable section, said twist-prevention sections extending from said fixed section.

2. The color cathode ray tube according to claim 1, wherein said supporting means are fixed respectively to four corners of said frame means by welding.

3. The color cathode ray tube according to claim 1, wherein each of said twist-prevention sections is made in a flat plate form.

4. The color cathode ray tube according to claim 1, wherein each of said twist-prevention sections is made in a cylindrical form.

5. The color cathode ray tube according to claim 3, wherein said twist-prevention sections are arranged close to both side ends of said resiliently deformable section and across said hole of said resiliently deformable section.

6. The color cathode ray tube according to claim 3, wherein said twist-prevention sections are arranged close to a welded section of said fixed section where said resiliently deformable section is welded to said fixed section.

7. The color cathode ray tube according to claim 4, wherein said resiliently deformable section has twist-prevention holes close to said hole and said twist-prevention sections are inserted into said twist-prevention holes.

8. The color cathode ray tube according to claim 1, wherein said supporting means are made of stainless steel.

* * * * *